US012590784B2

(12) United States Patent
Carelli

(10) Patent No.: US 12,590,784 B2
(45) Date of Patent: Mar. 31, 2026

(54) HANDLE ASSEMBLY

(71) Applicant: Derrin Carelli, Aspen, CO (US)

(72) Inventor: Derrin Carelli, Aspen, CO (US)

( * ) Notice: Subject to any disclaimer, the term of this patent is extended or adjusted under 35 U.S.C. 154(b) by 186 days.

(21) Appl. No.: 18/494,238

(22) Filed: Oct. 25, 2023

(65) Prior Publication Data

US 2024/0133660 A1 Apr. 25, 2024
US 2024/0230284 A9 Jul. 11, 2024

Related U.S. Application Data

(60) Provisional application No. 63/419,104, filed on Oct. 25, 2022.

(51) Int. Cl.
*F41H 9/10* (2006.01)
*A45B 3/14* (2006.01)

(52) U.S. Cl.
CPC ..... *F41H 9/10* (2013.01); *A45B 3/14* (2013.01)

(58) Field of Classification Search
CPC ..... F41H 9/10; A45B 3/14
USPC ..... 222/192
See application file for complete search history.

(56) References Cited

U.S. PATENT DOCUMENTS 3,756,467 A * 9/1973 Anketell ..... F41H 9/10 463/47.4
5,086,377 A * 2/1992 Roberts ..... F21V 33/0064 222/113
5,197,734 A * 3/1993 Ashihara ..... F21V 33/0064 222/113
5,405,134 A * 4/1995 Wolfram ..... F21V 33/0064 463/47.4
5,429,389 A * 7/1995 Shandell ..... A63C 11/225 280/821
5,709,635 A * 1/1998 Denison ..... A63B 21/072 482/106
5,839,461 A * 11/1998 Lambeth, Jr. ..... A45B 3/00 222/113
5,875,945 A * 3/1999 Roach ..... F41H 9/10 294/149
5,901,723 A * 5/1999 Ames ..... B65D 83/22 135/70
6,957,750 B1 * 10/2005 Trudell ..... F41H 9/10 222/174
7,121,432 B2 * 10/2006 Kostal ..... F41H 9/10 222/113
7,654,275 B2 * 2/2010 Ewell ..... A45B 3/00 135/66

(Continued)

*Primary Examiner* — Paul R Durand
*Assistant Examiner* — Michael J. Melaragno
(74) *Attorney, Agent, or Firm* — Leyendecker & Lemire, LLC

(57) ABSTRACT

A handle assembly is described. Embodiments of the handle assembly can include a main body and a cap. The main body can be contoured to be gripped by a user and can include a chamber for receiving a canister of deterrent spray therein. The contour of the main body can generally index knuckles of a user holding the main body with a dispensing nozzle of a canister configured to dispense a deterrent. The cap can be removably coupled to the main body and can encapsulate the canister in the chamber. To dispense contents of the canister, a user may first pop the cap off to engage the canister, second the user can activate the canister, and third the user can dispense the contents of the canister.

20 Claims, 11 Drawing Sheets

(56) References Cited

U.S. PATENT DOCUMENTS

| | | | | |
|---|---|---|---|---|
| 8,356,614 | B2 * | 1/2013 | Forrester | A45B 3/14<br>222/402.2 |
| 8,375,967 | B1 * | 2/2013 | Stratton | A45B 3/14<br>222/174 |
| 9,192,152 | B1 * | 11/2015 | Sparks | A45B 3/00 |
| 10,588,387 | B1 * | 3/2020 | Lee | A45B 3/14 |
| 2007/0045346 | A1 * | 3/2007 | Siteman | F41H 9/10<br>222/174 |
| 2011/0132419 | A1 * | 6/2011 | Forrester | A45B 3/14<br>135/66 |
| 2016/0298939 | A1 * | 10/2016 | Kuo | A45B 3/00 |
| 2024/0133660 | A1 * | 4/2024 | Carelli | A45B 3/14 |

* cited by examiner

HANDLE ASSEMBLY

CROSS-REFERENCE TO RELATED APPLICATION

This application claims the benefit of U.S. Provisional Application No. 63/419,104, filed Oct. 25, 2022.

BACKGROUND

Pepper spray can be an effective way of keeping those with nefarious intent at a distance, and importantly can temporarily disable an assailant giving the would-be victim a chance to escape. Pepper spray is most often carried by women and carried in a purse or handbag often coupled to a key chain or ring.

Women and men alike enjoy hiking whether on urban trails or in the backcountry. Often hikers and walkers experience long stretches where they are largely alone making them particularly vulnerable to those that might assault or mug them. However, walkers and more often hikers, do not tend to carry a purse by their sides when walking or hiking. They may have a daypack, backpack, or waist pack, but if pepper spray is stored in one of these packs, the hiker may not be able to access it before being overtaken by an assailant.

Walking sticks or hiking poles are often used by hikers and walkers to provide greater stability but also to exercise the arms. Placing a container of pepper spray in the handle of a walking stick or pole has been described in various patents, which would seem to offer quicker access of the spray in a time of need compared to spray stored in a pack. However, during a vigorous walk or hike, a hiker often tends to change his/her hold on the handle of the pole repeatedly in such a manner that would run the risk of accidentally pressing the trigger/nozzle of the pepper spray and discharging it in the hiker's vicinity. Accordingly, the proposed solutions tend to provide covers over the nozzle that have to slide or flip from the nozzle before the nozzle can be pressed. Unless the hiker has practiced quickly sliding or flipping such a cover to expose a trigger, the action can be relatively unintuitive and require an inordinate amount of attention in a critical time of need wasting valuable fractions of a second as an assailant rapidly approaches. Furthermore, sometimes pivots points, and slides can become jammed or otherwise fail if not properly and artfully actuated also increasing the risk that a hiker will not be able to access the pepper spray trigger soon enough to thwart an attack.

DETAILED DESCRIPTION

Figure 1A:
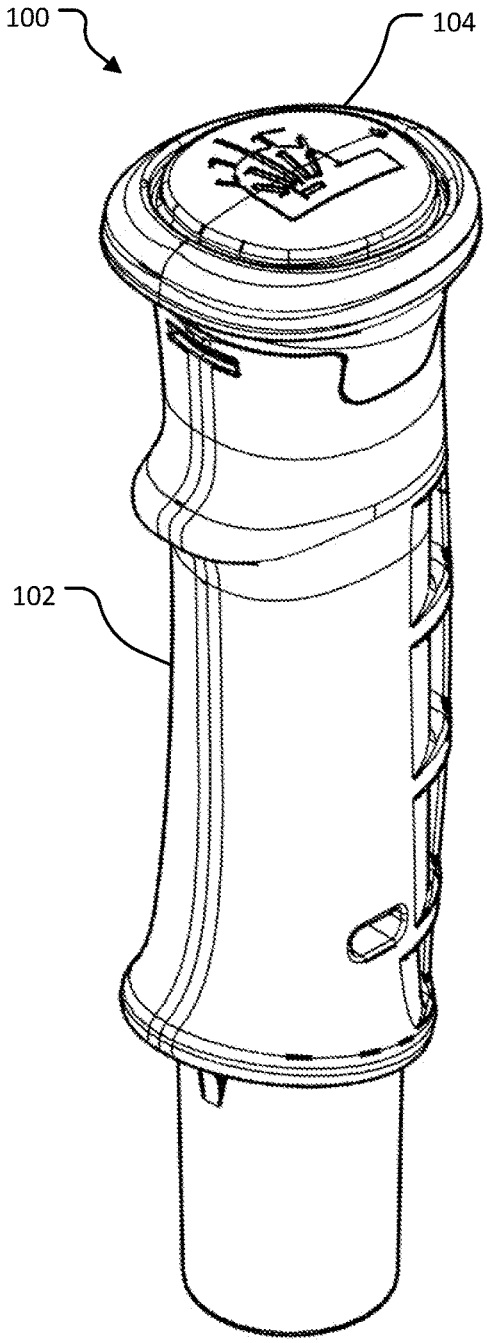
FIG. 1A is a perspective view of a handle assembly according to one embodiment of the present invention.

Embodiments of the present invention include a handle assembly that can be implemented with a support pole (e.g., walking stick, hiking pole, etc.). The handle assembly can be configured to store an easily accessible canister securely and safely. Typically, the canister can contain a deterrent spray (e.g., pepper spray, bear spray, etc.). Embodiments include a handle assembly in combination with a pole and just a handle assembly that may be coupled to a pre-existing pole.

In one embodiment, the handle assembly can include, but is not limited to, a main body and a cap. Advantageously, a trigger of the pepper spray canister can be covered by the cap that may prevent inadvertent discharge while the handle assembly may be used. However, the cap can be configured to be easily and quickly flipped off the main body by a thumb of a user to reveal the pepper spray canister. The handle assembly can be received and typically fixedly attached to the top of a shaft (e.g., a walking stick, hiking pole, etc.). Although not specifically illustrated, the shaft can be substantially similar to those found on prior art walking sticks or hiking poles being of similar length, diameter, and construction.

The handle assembly can be made of any suitable material. In one instance, the handle assembly can be molded from a polymeric material. Some versions may comprise a hard plastic core, which can receive a foam, cork, or soft elastomeric layer fitted over the core. In at least one variation, the soft compliant layer can be over-molded on top of the hard core. In yet other versions, the handle can be substantially or almost entirely molded from a firm elastomeric material that has some give to provide a comfortable surface for a person to hold but also is sufficiently rigid to provide structural stability to the handle assembly.

Regardless of the material or materials used to construct the handle assembly, the material(s) can typically be characterized by having both an upper (first) and a lower (second) chamber. Typically, the chambers can be cylindrical in shape. The lower chamber can be configured to receive and secure a pole (or staff) therein. The upper chamber can be configured to removably receive a canister therein. The handle assembly may further be characterized by a snap-fit cap that typically covers the upper chamber.

An exterior surface of the handle assembly can include various topographical features designed to make the grip more ergonomic, and as a result, more comfortable to grip for extended periods of time. For instance, the main body may include a circumferential bottom ridge that helps keep the gripping hand from sliding off the main body during use.

An inside surface of the upper chamber of the main body can include a squared circumferential lip (or flange) that can extend inwardly a short distance. The main body can include the aforementioned outwardly extending squared circumferential flange to interface with a bottom of a canister. As can be appreciated, the upper chamber flange can be positioned such that a nozzle of a canister inserted into the upper chamber may be positioned just above a top of the main body. In some embodiments, the upper chamber flange may include two semi-circular halves with a gap between ends of the halves. These gaps can coincide with apertures of the handle to allow for a lever to be passed into and under a bottom of a canister to aid in removal of the canister.

In general, the canister can be received in the upper chamber with a top portion (or head) of the canister including a nozzle rising above a top surface of the main body. The canister can include a lever arm that extends radially from a top center portion of the canister that can be rotated clockwise or counter clockwise by the user to move the nozzle into an operative position providing a rapidly and intuitively deployed fail-safe to prevent an unintended discharge. The axis of the lever arm can be aligned with the nozzle discharge opening on the other side of the canister center portion. Accordingly, the lever arm essentially points to the direction of pepper spray discharge giving the user a visual and tactile reference from which to aim the pepper spray canister while received in the upper chamber of the main body.

As can be appreciated, the canister can be removed and replaced with a new one after the pepper spray has been used, or periodically after the shelf life of the pepper spray has passed. Of important note is the head that cradles the nozzle's center portion and forms two opposing vertical slots. The first slot receives the lever arm and set limit stop between the open and closed positions of the nozzle. The second slot exposes the nozzle opening when the lever arm is rotated to rest against the open limit stop permitting spray to be projected therefrom. When the lever arm is resting against the closed limit stop, the nozzle opening resides behind a wall of the head.

In a typical implementation, a user may place their thumb under and against a disengagement member of the cap and apply an upwardly pressure until the cap pops off the handle exposing the head and nozzle of the canister. Next, the user can place their thumb on a lever arm of the canister and rotate the lever arm from a closed position to an open position. In the open position, the user may press downwardly on the lever arm to dispense a stream of pepper spray from the canister. In one instance, the lever arm can be rotated counterclockwise to be put in the open position. In another instance, the lever arm can be configured to be rotated clockwise to move the lever arm into the open position.

In one example implementation, as a user moves their thumb to pop off the cap in a time of stress or danger, the thumb can slide over the interface instead coming into contact with the cap flange wherein leverage to the cap can be applied. Of note, the top of the cap can generally be flat which may permit a user to brace their hand against the top of the cap. Typically, the palm of the user may brace against a top of the cap when holding the walking stick from the top of the handle instead of the more traditional grip around the handle. Of significant note, the cap can provide sufficient coverage of the canister to help ensure that the canister is not accidently activated.

In one embodiment, a handle assembly can be implemented for use with a walking stick (or hiking pole) and include an upper chamber for containing a pepper spray canister. The cap can be provided to enclose the top end of the chamber and enclose a head and nozzle of the pepper spray canister. The pepper spray canister can include a nozzle with a radially extending lever arm that permits the nozzle to be rotated and moved between active and inactive positions.

In one example, a method of implementing a handle assembly for a support pole can include, but is not limited to the steps of: providing a handle assembly; grabbing the handle with a thumb of a user indexed below and proximate the cap; engaging a disengagement member of the cap to remove the cap from the handle; rotating a lever arm of the canister from an inactive position to an active position; and pressing the lever arm to dispense contents from the canister. The handle assembly can be defined by a main body, a first chamber, and a cap. The main body can be contoured to be gripped by a hand. The first chamber can include an opening at a top of the main body configured to receive a canister therein. The cap can be removably coupled to the top of the main body and adapted to enclose the top of the main body and the first chamber with the canister therein. The method may further include the steps of: providing a lever; passing the lever through the aperture into the first chamber; engaging a bottom of the canister with the lever; leveraging the bottom of the canister with the lever to push the canister upwards; and removing the canister from the first chamber.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Handle Assembly

Figure 1B:
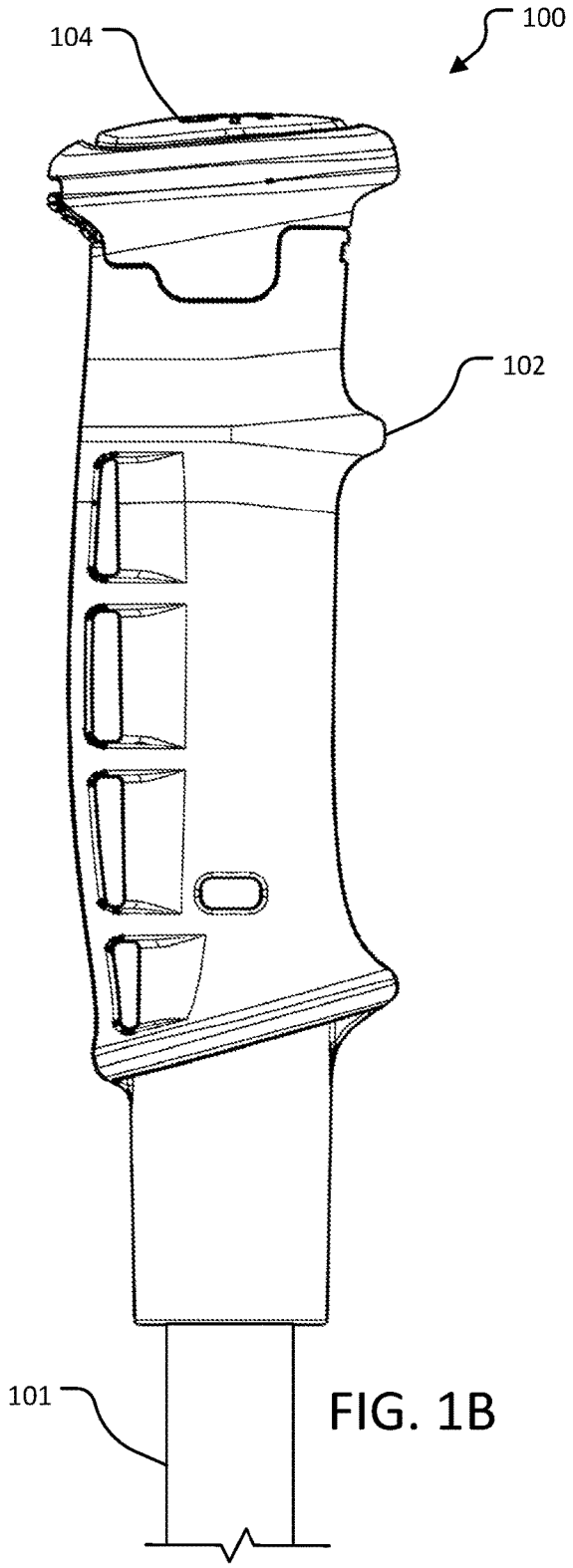
FIG. 1B is a side view of a handle assembly according to one embodiment of the present invention.
Figure 1C:
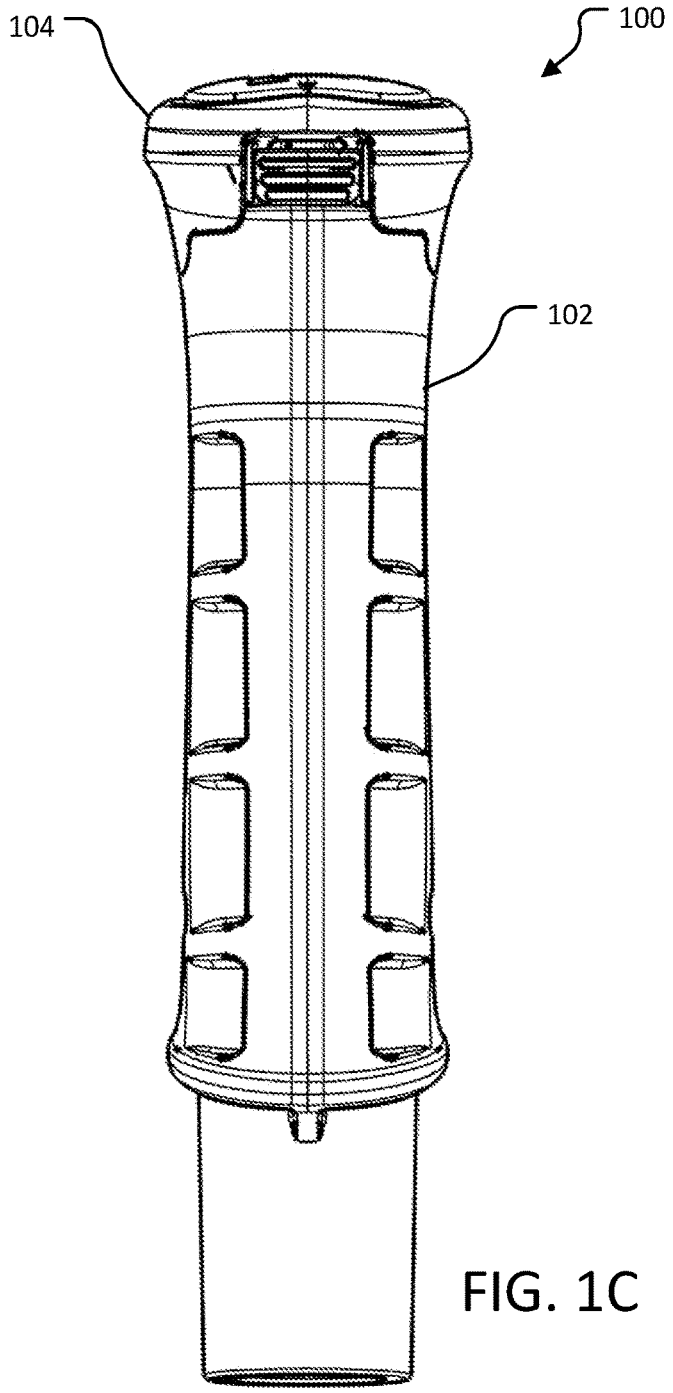
FIG. 1C is a back view of a handle assembly according to one embodiment of the present invention.

Referring to FIGS. 1A-1C, detailed diagrams of an embodiment 100 of a handle assembly are illustrated. The handle assembly 100 can be implemented with a hiking pole 101 (or similar shaft) to provide quick and easy access to a deterrent stored in the handle assembly 100. For instance, the handle assembly 100 can store a canister of pepper spray that may be easily accessible to a user when using the hiking pole with the handle assembly 100. FIG. 1A includes a front perspective view of the handle assembly 100. FIG. 1B includes a side view of the handle assembly 100 and the hiking pole 101. FIG. 1C includes a back view of the handle assembly 100.

As generally shown, the handle assembly 100 can include, but is not limited to, a main body 102 and a cap 104. The cap 104 can be removably coupled to the main body 102. The cap 104 can be coupled to an upper portion of the main body 102. The main body 102 can be contoured to be gripped by a hand of a user where the user holding the handle assembly 100 can have their hand indexed for quick removal of the cap 104. Further, when the user is grasping the main body 102, a canister of deterrent can be oriented to align with a hand of the user such that the user can easily aim a nozzle of the canister based on their hand.

Figure 2A:
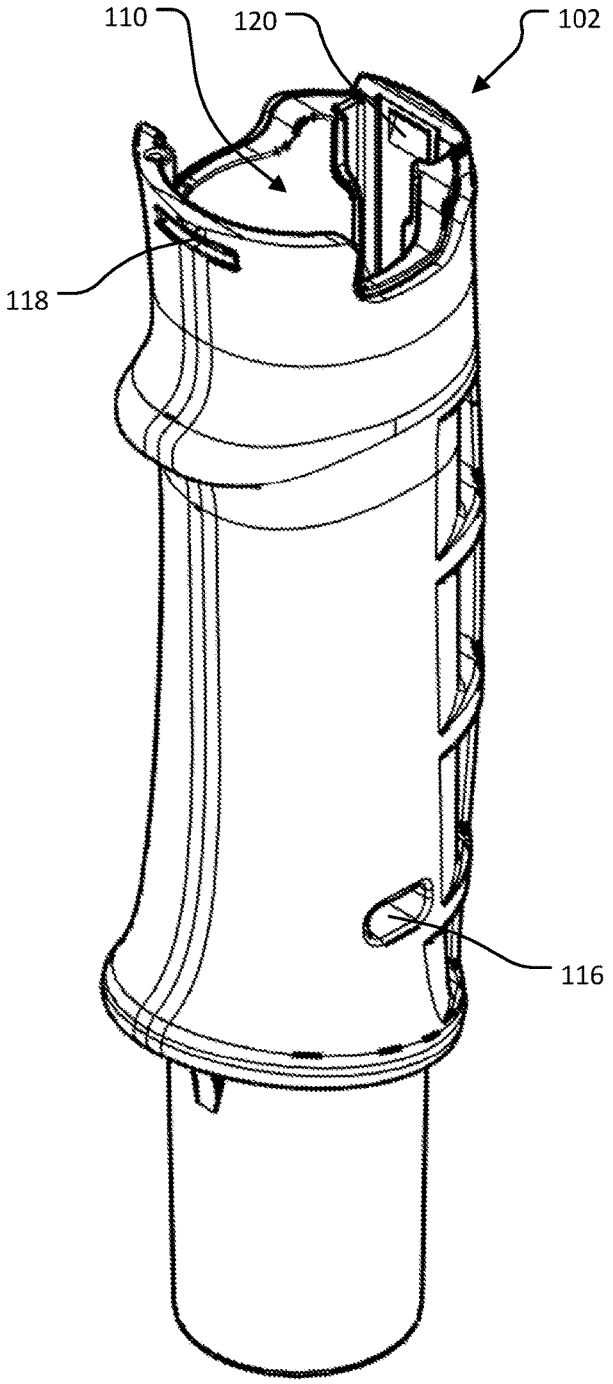
FIG. 2A is a perspective view of a main body according to one embodiment of the present invention.
Figure 2B:
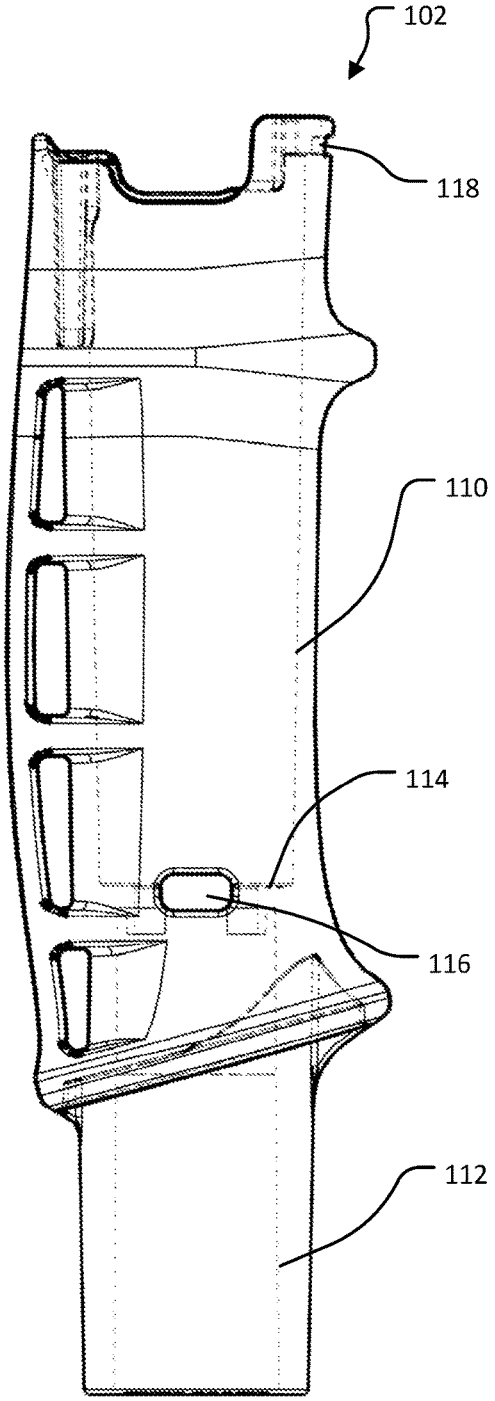
FIG. 2B is a side view of a main body according to one embodiment of the present invention.
Figure 2C:
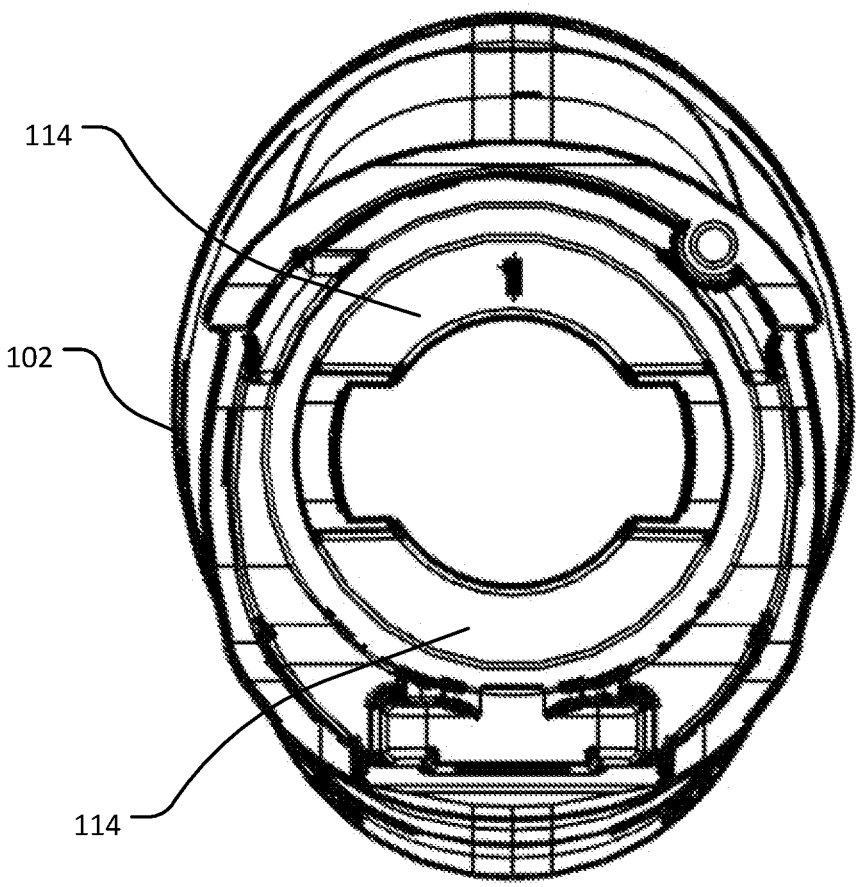
FIG. 2C is a top view of a main body according to one embodiment of the present invention.
Figure 2D:
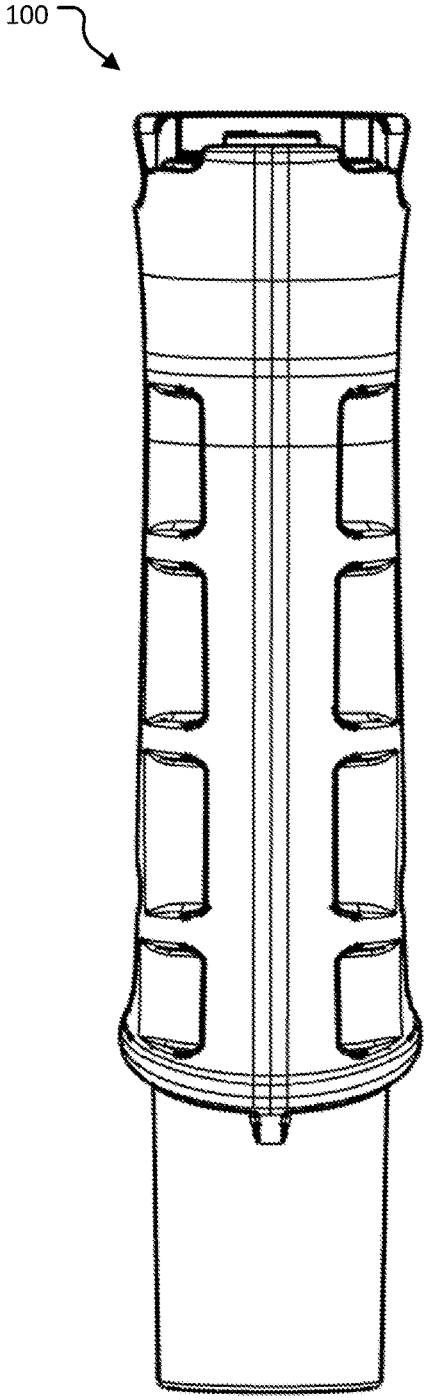
FIG. 2D is a back view of a main body according to one embodiment of the present invention.
Figure 2E:
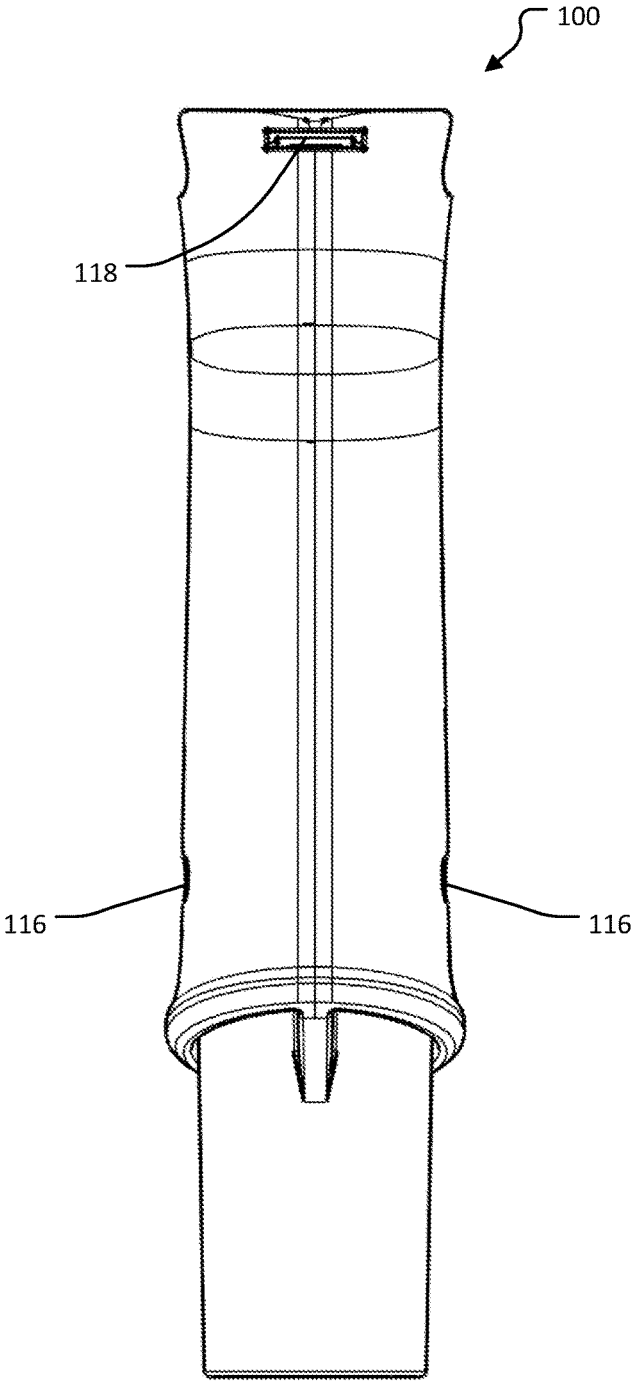
FIG. 2E is a front view of a main body according to one embodiment of the present invention.

Referring to FIGS. 2A-2E, the main body 102 of the handle assembly 100 is shown without the cap 104. FIG. 2A includes a front perspective view of the main body 102. FIG. 2B includes a side view of the main body 102. FIG. 2C includes a top view of the main body 102. FIG. 2D includes a back view of the main body 102. FIG. 2E includes a front view of the main body 102.

The main body 102 can include a first chamber 110 (or cavity) and a second chamber 112 (or cavity), as shown in FIG. 2B. The first chamber 110 and the second chamber 112 can generally be defined by substantially cylindrical bores sized to receive respective members therein. The first chamber 110 can be configured to receive a canister therein. The second chamber 112 can be configured to receive the pole 101 (or shaft) therein. The canister can generally be a canister filled with a deterrent including, but not limited to, pepper spray, bear spray, etc. The canister can be inserted into the first chamber 110 such that a dispensing portion of the canister can be located above a top of the main body 102. Typically, the shaft 101 can be a walking pole or similar device to aid a user in walking/hiking. In some instances, the walking pole may be a collapsible pole.

A bottom of the first chamber 110 may be defined by a shelf 114 adapted to interface with a bottom of the canister. A location of the shelf 114 can be such that when the canister is inserted into the first chamber 110 a top of the canister can be located above the top of the main body 102. The main body 102 can further include a pair of apertures 116 located on opposing sides of the main body 102. The apertures 116 can pass through a wall of the main body and coincide with gaps in the shelf 114.

Referring to FIG. 2C, a top view of the main body 102 is shown. In one instance, the shelf 114 can include two flanges protruding into an interior of the chamber 110. The two flanges may be defined by two semi-circular halves with a gap between ends of the halves. These gaps can coincide with the pair of apertures 116 of the main body 102 to allow for a lever to be passed into and under a bottom of a canister to aid in removal of the canister from the first chamber 110.

In one example, the shelf 114 can be located on an inside surface of the first chamber 110 of the main body 102. The shelf 114 can be defined by a squared circumferential lip (or flange) that can extend inwardly a short distance. In some embodiments, the flange may include two semi-circular halves with a gap between ends of the halves. These gaps can coincide with apertures 116 of the main body 102 to allow for a lever to be passed into and under a bottom of a canister to aid in removal of the canister.

Referring back to FIG. 2B, a side view of the main body 102 is illustrated. Of note, a top portion of the main body 102 can include cutouts allowing for a user to access more of the canister for removal from the first chamber 110. As can be appreciated, the cutouts can allow a user to grab the canister where the cutouts are. The cap 104 can be configured to cover the cutouts when attached to the main body 102. An upper portion of the main body 102 can include an engagement slot 118 for interfacing with a front of the cap 104. The upper portion of the main body 102 can further include an engagement member 120 for interfacing with a back of the cap 104.

Figure 3A:
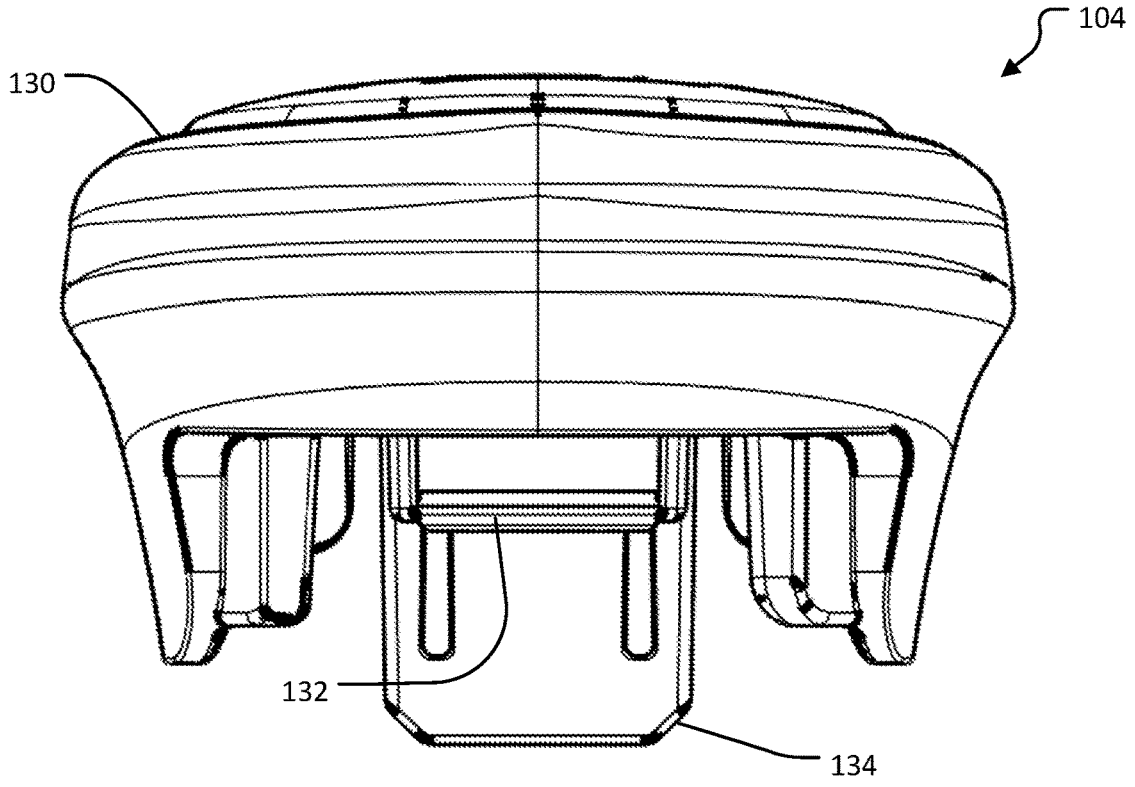
FIG. 3A is a front view of a cap according to one embodiment of the present invention.
Figure 3B:
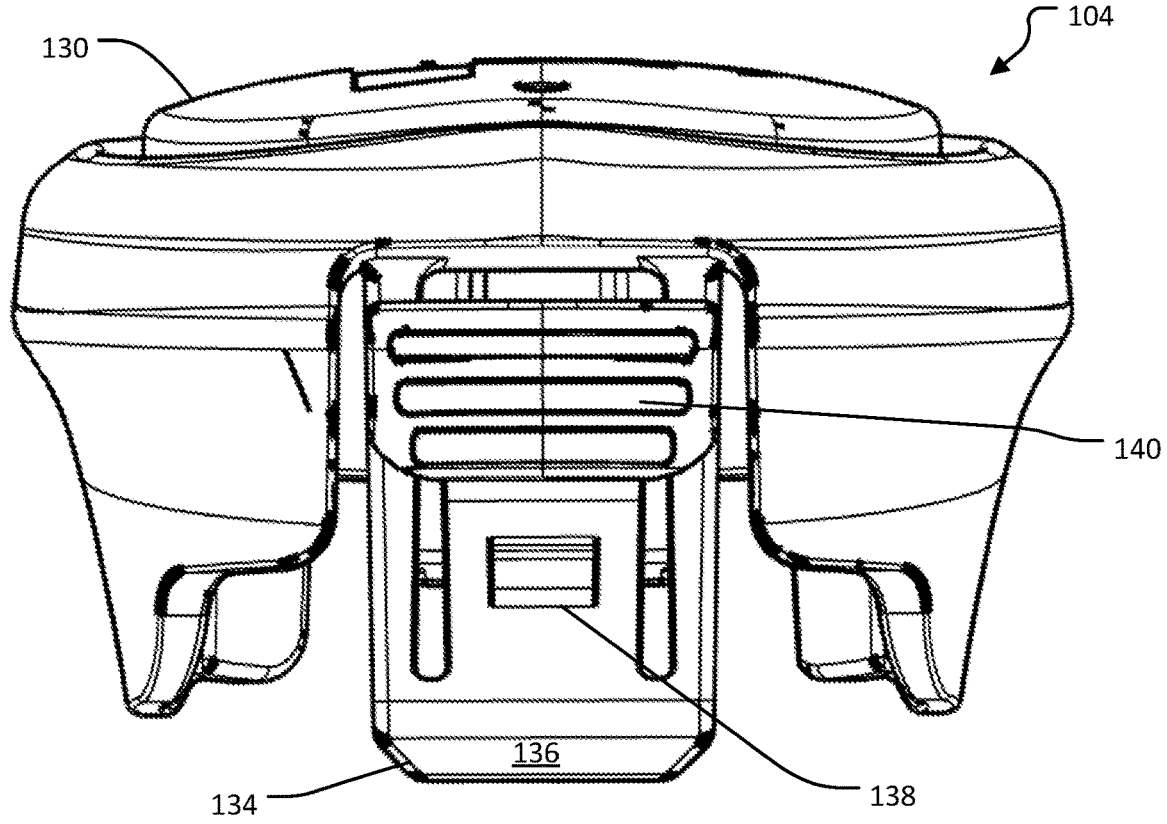
FIG. 3B is a back view of a cap according to one embodiment of the present invention.
Figure 3C:
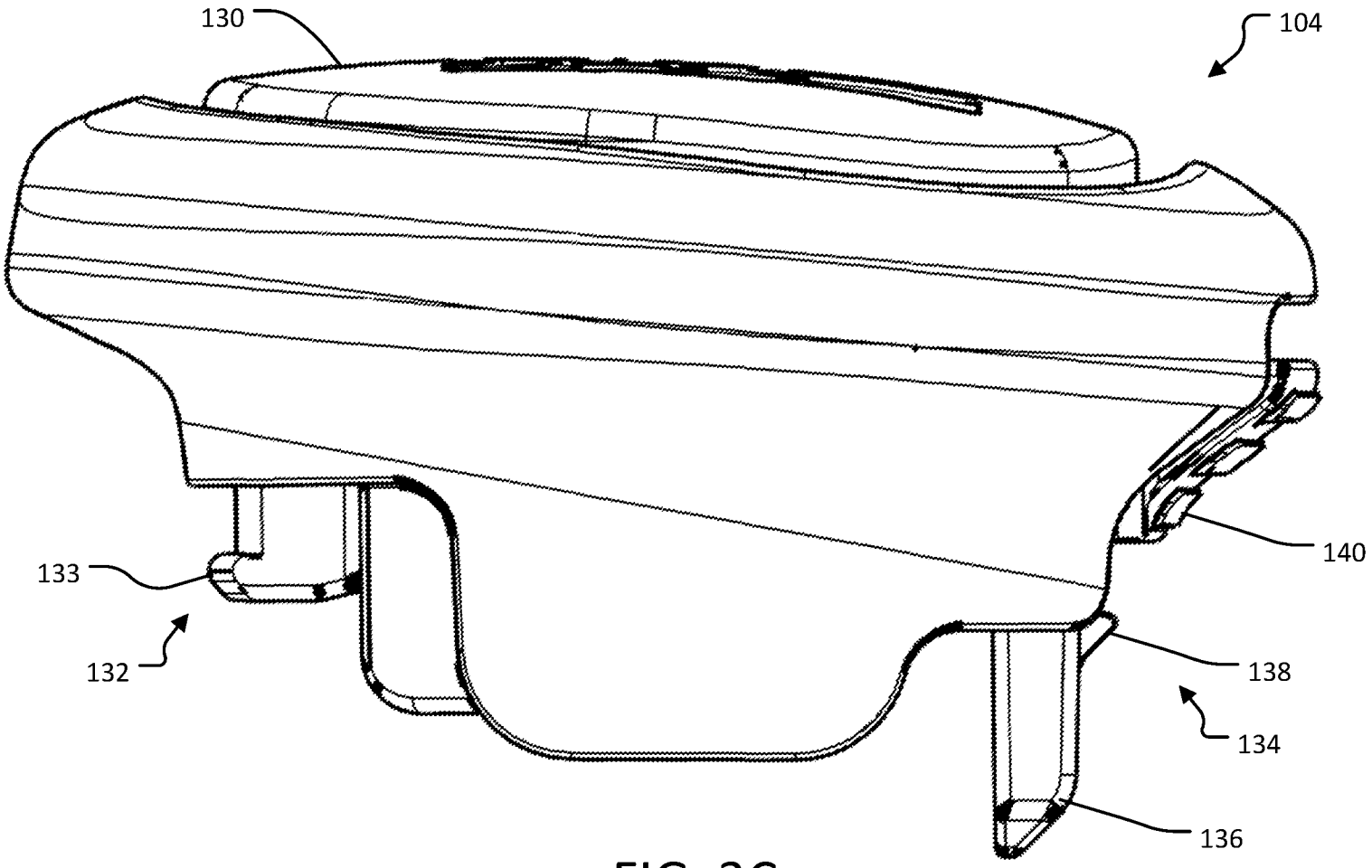
FIG. 3C is a side left view of a cap according to one embodiment of the present invention.

Referring to FIGS. 3A-3C, several different views of the cap 104 are illustrated. FIG. 3A includes a front view of the cap 104. FIG. 3B includes a back view of the cap 104. FIG. 3C includes a side view of the cap 104. As generally shown, the top of the cap 104 can generally be flat. As can be appreciated, the flat top of the cap 104 can permit a user to brace their hand against the top of the cap.

The cap 104 can include, but is not limited to, a cap body 130, a first engagement member 132, and a second engagement member 134. The cap body 130 can be contoured to mate with the top of the main body 102. As shown in FIGS. 1A-1B, the cap body 130 can include sides that cover the cutouts of the main body 102.

The first engagement member 132 can be configured to interface with the engagement slot 118 of the main body 102. Typically, the first engagement member 132 can be sized to fit into the engagement slot 118. The second engagement member 134 can be configured to interface with the main body engagement member 120. The second engagement member 134 can be implemented as a disengagement member. In one instance, the engagement member 120 can be a depression sized to receive the second engagement member 134. When securing the cap 104 to the main body 102, the cap 104 can be angled such that the first engagement member 132 can be inserted into the engagement slot 118. The cap 104 may then be rotated downwards with the first engagement member 132 in the engagement slot 118 so that the second engagement member 132 can interface with and engage the main body engagement member 120. To disengage the cap 104 from the main body 102, a user can press the second engagement member 134 such that the cap 104 can be rotated upwards and removed from the main body 102. As can be appreciated, a user may then have access to the canister stored in the first chamber 110.

The first engagement member 132 can include a small protruding member 133 that can be sized to fit into the engagement slot 118 of the main body 102. Of note, the protruding member 133 can generally be inserted into the engagement slot 118 at an angle when coupling the cap 104 to the main body 102. The protruding member 133 can be shaped to allow for the protruding member 133 to be inserted into the engagement slot 118 while still being able to be rotated and stayed engaged with the engagement slot 118.

As shown in FIG. 3B, the second engagement member 134 can be defined by a main body 136, a protrusion 138, and a ribbed section 140. The main body 136 can include a pair of slots separating the protrusion 138 and the ribbed section 140 from the main body 136. The protrusion 138 can be moved slightly when the ribbed section 140 is engaged. The main body 136 can remain relatively fixed in place and not move when a user engages the ribbed section 140. When a user presses the ribbed section 140, the protrusion 138 can be moved slightly backwards allowing for the second engagement member 134 to be disengaged from the main body engagement member 120. As shown in FIG. 3C, the ribbed section 140 can follow a contour of the cap body 130.

Figure 4A:
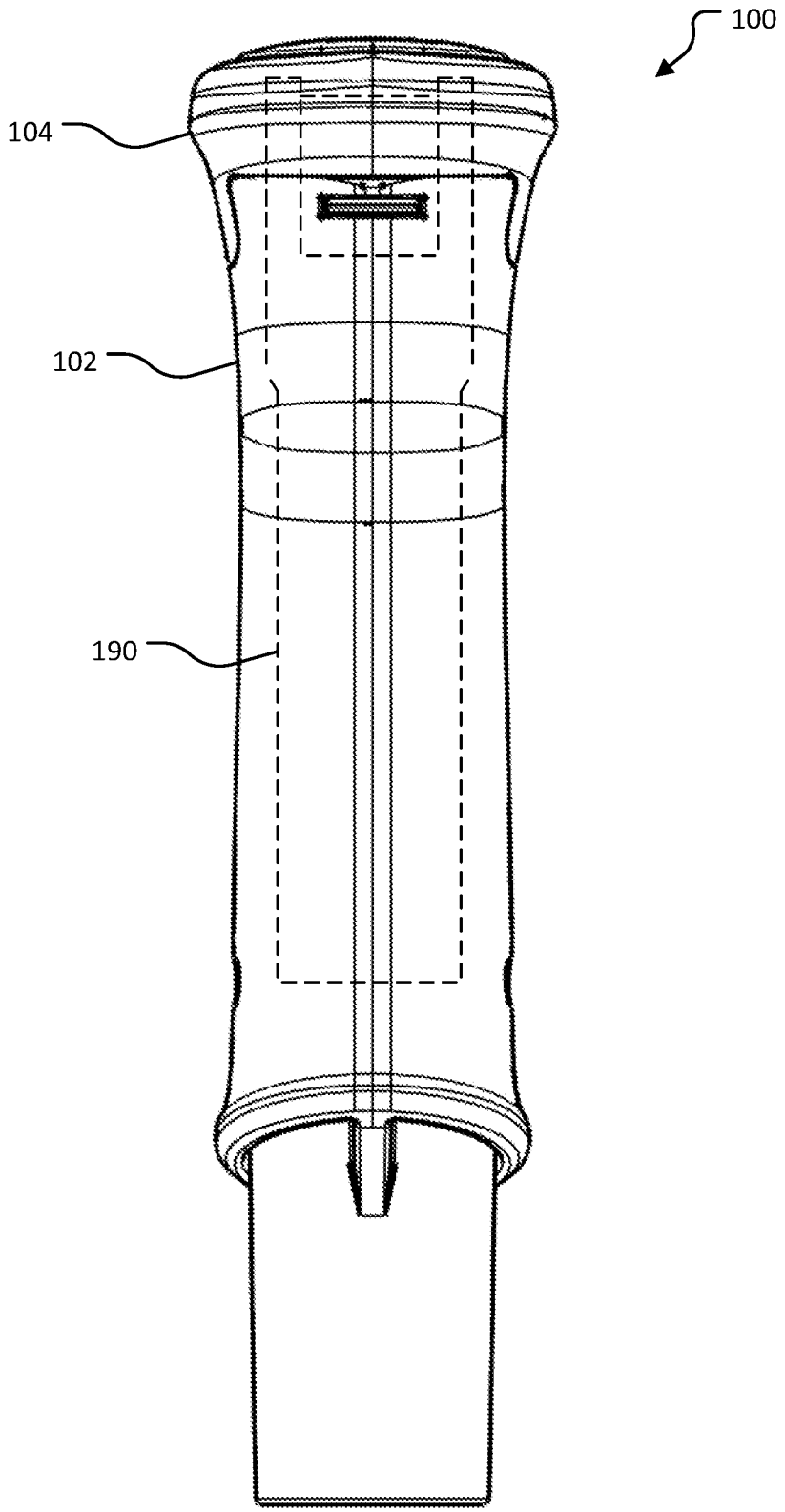
FIG. 4A is a front view of a handle assembly including a canister according to one embodiment of the present invention.
Figure 4B:
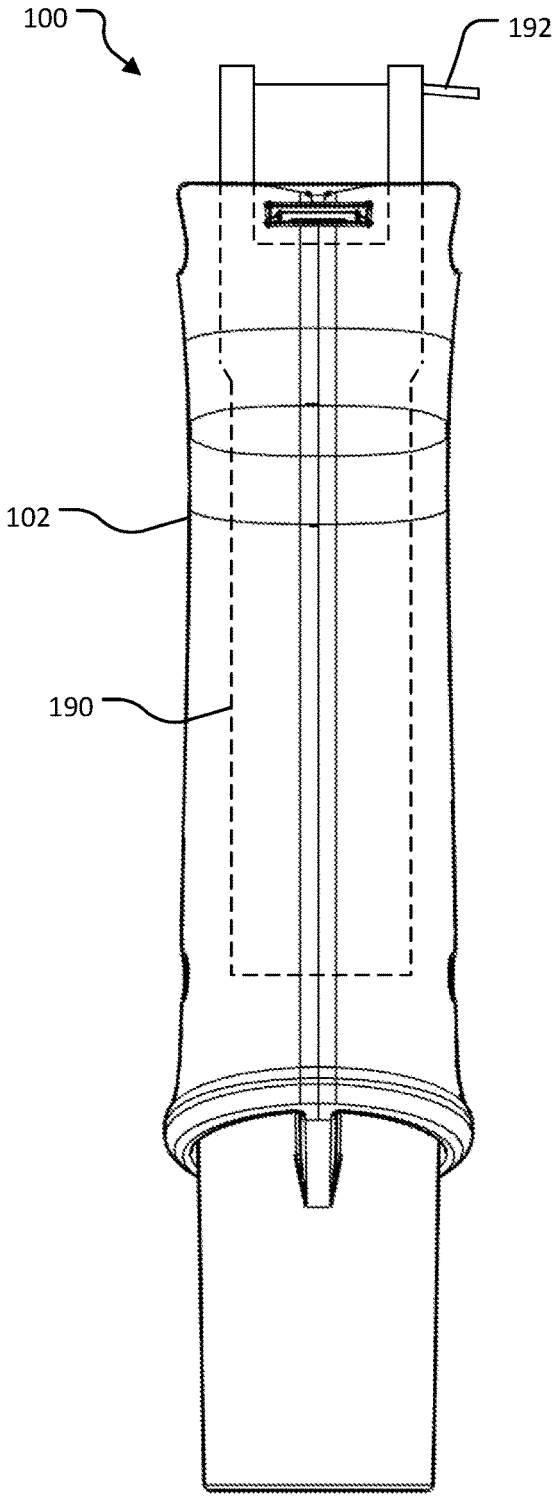
FIG. 4B is a front view of a main body including a canister in an inactive configuration according to one embodiment of the present invention.
Figure 4C:
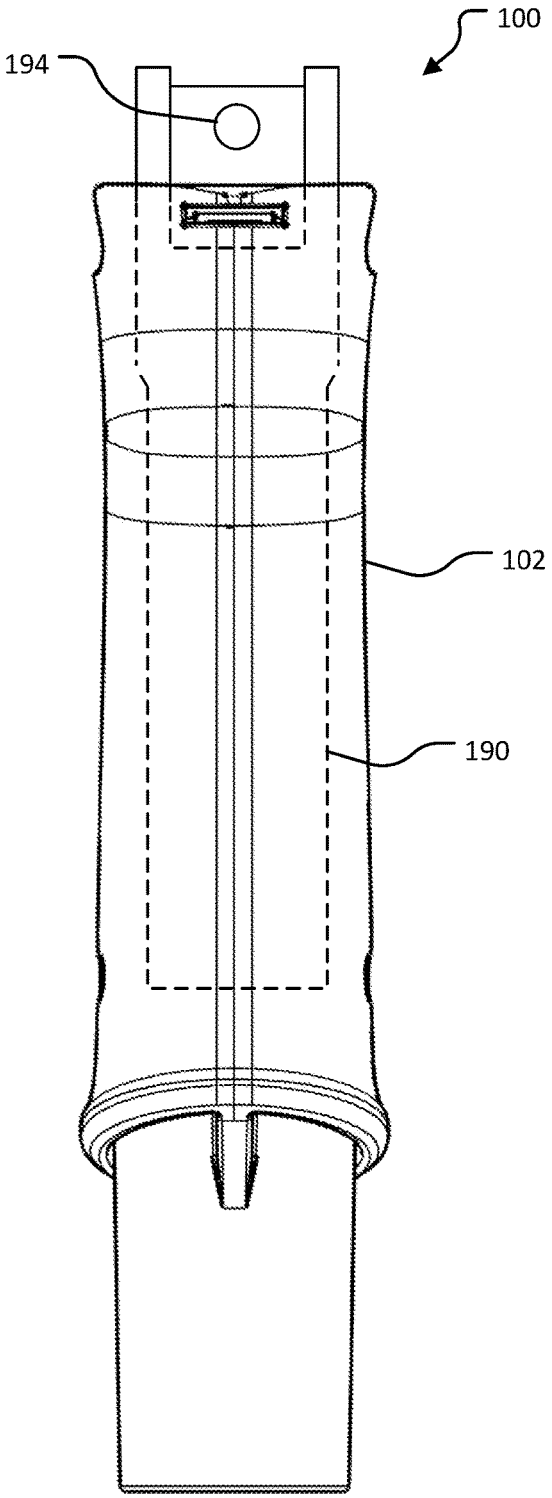
FIG. 4C is a front view of a main body including a canister in an active configuration according to one embodiment of the present invention.

Referring to FIGS. 4A-4C, detailed diagrams of a canister 190 inserted into the first chamber 110 of the main body 102 are illustrated. FIG. 4A includes a front view of the handle assembly 100 with the canister 190 inserted into the main body 102. FIG. 4B includes a front view of the handle assembly 100 with the cap 104 removed and the canister 190 in a non-operative (or inactive) configuration. FIG. 4C includes a front view of the handle assembly 100 with the cap 104 removed and the canister 190 in an operative (or active) configuration.

In one instance, to activate the canister 190, a user may use their thumb that disengaged the cap 104 from the main body 102 to activate the canister 190. As can be appreciated, this can allow for a spray of the canister to be indexed to the contour of the main body 102 dictating how a user holds the handle assembly 100.

Described hereinafter is one example embodiment of a deterrent and a propellant stored under pressure in a canister. The canister 190 can include a lever arm 192 and a nozzle 194. The lever arm 192 and the nozzle 194 can be implemented to dispense the contents of the canister 190 based on an action of the user. The lever arm 192 can extend radially from a top center portion of the canister 190 that can be rotated clockwise (or counterclockwise) by the user to move the nozzle 194 into an operative position providing a rapidly and intuitively deployed fail-safe to prevent an unintended discharge. The axis of the lever arm 192 can be aligned with the nozzle 194 discharge opening on the other side of the canister 190 center portion. Accordingly, the lever arm 192 can essentially point to the direction of pepper spray discharge giving the user a visual and tactile reference from which to aim the pepper spray canister while received in the handle. The propellant stored under pressure can be implemented to dispense the deterrent when the lever arm 192 is in an active configuration and the lever arm 192 is depressed. Of note, the lever arm 192 is restricted from being depressed when in the inactive configuration.

Figure 5A:
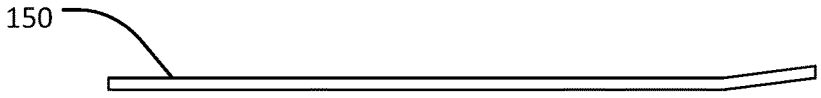
FIG. 5A is a side view of a lever according to one embodiment of the present invention.
Figure 5B:
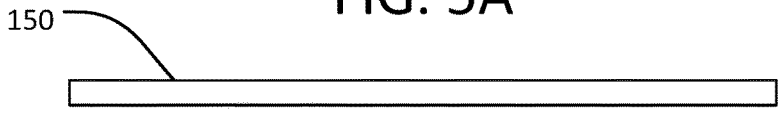
FIG. 5B is a top view of a lever according to one embodiment of the present invention.
Figure 5C:
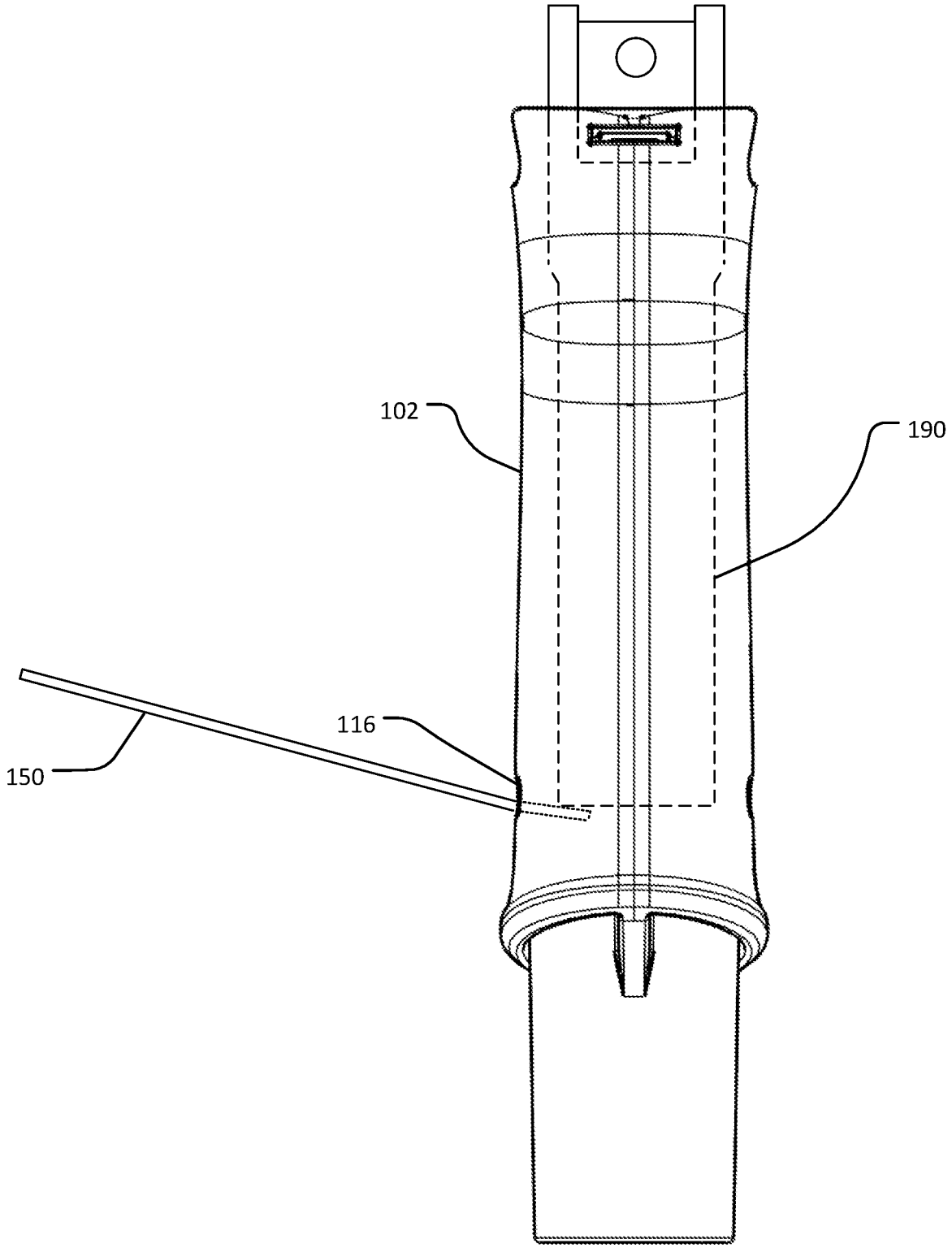
FIG. 5C is a side view of a lever interfacing with a canister in a main body according to one embodiment of the present invention.
Figure 5D:
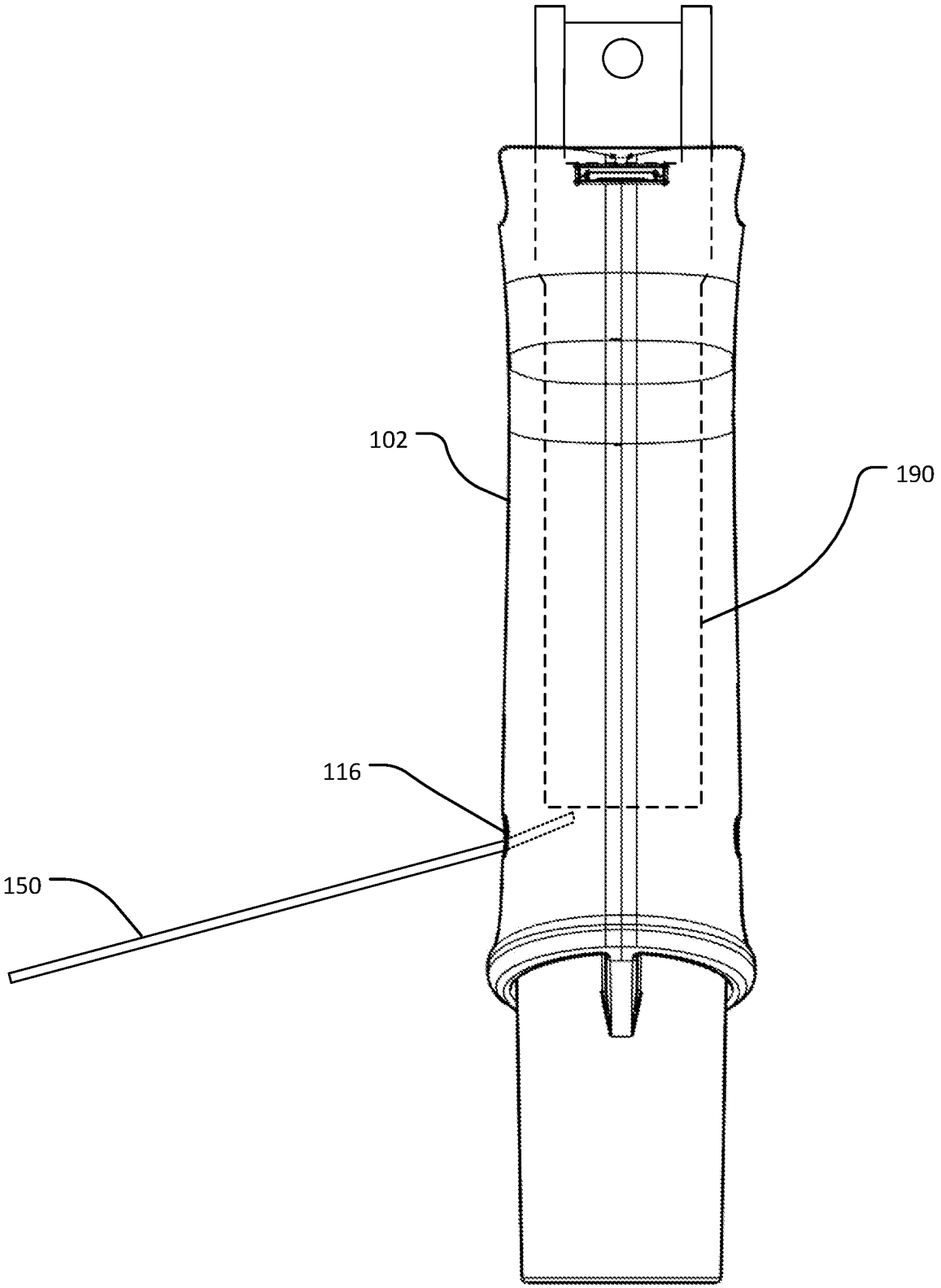
FIG. 5D is a side view of a lever interfacing with a canister in a main body according to one embodiment of the present invention.

Referring to FIGS. 5A-5D, detailed diagrams of a lever 150 for use with the handle assembly 100 are illustrated. FIG. 5A includes a side view of the lever 150. FIG. 5B includes a top view of the lever 150. FIG. 5C includes a front view of the lever 150 interfacing with the canister 190 inside the main body 102. FIG. 5D includes a front view of the lever 150 interfacing with the canister 190 inside the main body 102.

The lever 150 can be implemented to aid in removing a canister inserted in the first chamber 110. As shown in FIG. 5A, the lever 150 can include a leveraging end that is angled relative to the rest of the lever 150. The lever 150 can have a substantially rectangular shape when viewed from the top, as shown in FIG. 5B. As shown in FIG. 5C, the lever 150 can be sized to fit into one of the apertures 116. When inserted into one of the apertures 116, the lever 150 can be placed proximate a bottom of the canister 190. The leveraging end can be inserted into the aperture 116 of the main body 102. When the lever 150 is moved downwards, as can be appreciated from FIG. 5C to FIG. 5D, the leveraging end can be rotated upwards to engage the canister 190. As shown in FIG. 5D, the lever 150 can move the canister 190 upwards to help a user in removal of the canister 190 from the first chamber 110 of the main body 102.

Of significant note, safety features of the handle assembly 100 can be implemented in an emergency in 3 steps. Further, each of the three steps may be completed by a thumb of a user. The three steps may be actively completed by a thumb of a user. However, it is to be appreciated that the three active steps do not take into account pre-existing factors (e.g., the main body being grasped by a hand of a user). In a first step, a thumb of a user may engage the disengagement member of the cap to remove the cap from the main body. Second, after the cap is removed from the handle assembly, the thumb of the user may move the lever arm of the canister from an inactive position to an active position. Third, once the lever arm is in an active position, the thumb of the user may be implemented to depress the lever arm to dispense contents of the canister. As can be appreciated, the handle assembly can allow for a user to activate a safety measure using three simple steps via a single digit of a hand of the user. Further, a dispensing means of the canister can prematurely be indexed with a grasp of the user so that minimal though is needed to dispense the deterrent effectively.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

Embodiments are contemplated where the first chamber of the main body can include guide members such that the canister cannot be fully inserted into the first chamber unless the canister is properly aligned. Of note, unless the canister is fully inserted into the first chamber, the cap may not couple with the main body. The guide members can help properly align a canister such that a dispensing nozzle of the canister is aligned with knuckles of a user grasping the handle assembly. More specifically, the nozzle can be aligned with knuckles of a clenched first when the user is holding the handle assembly according to the contour of the main body.

I claim:

1. A method of implementing a handle assembly for a support pole comprising the steps of:

providing a handle assembly, the handle assembly defined by:

a main body contoured to be gripped by a hand;

a first chamber with an opening at a top of the main body configured to receive a canister therein; and a cap removably coupled to the top of the main body and adapted to enclose the top of the main body and the first chamber with the canister therein;

grabbing the handle with a thumb of a user indexed below and proximate the cap;

engaging a disengagement member of the cap to remove the cap from the handle;

rotating a lever arm of the canister from an inactive position to an active position; and pressing the lever arm to dispense contents from the canister.

2. The method of claim 1, wherein the cap is defined by a cap body, an engagement member, and the disengagement member.

3. The method of claim 1, wherein a bottom of the first chamber is defined by an interior shelf for a bottom of the canister to engage.

4. The method of claim 3, wherein the main body includes an aperture passing from one sidewall to another sidewall of the main body and the interior shelf.

5. The method of claim 4, further including the steps of:

providing a lever;

passing the lever through the aperture into the first chamber;

engaging a bottom of the canister with the lever;

leveraging the bottom of the canister with the lever to push the canister upwards; and removing the canister from the first chamber.

6. The method of claim 1, wherein the cap is defined by a cap body, an engagement member, and the disengagement member.

7. The method of claim 6, wherein the main body includes (i) an engagement slot for interfacing with the engagement member, and (ii) an engagement depression for interfacing with the disengagement member.

8. The method of claim 1, wherein a top portion of the main body includes two cutouts.

9. The method of claim 1, wherein the main body further includes a second chamber for receiving and coupling to the support pole.

10. A method of implementing a handle assembly adapted to store a canister therein, the method comprising:

providing a handle assembly, the handle assembly defined by:

a main body including a first chamber, a second chamber, and an aperture passing through opposing sidewalls of the main body and the first chamber; and a cap removably coupled to the main body;

inserting a canister into the first chamber of the main body;

attaching the cap to the main body;

removing the cap from the main body;

dispensing contents from the canister with the cap removed from the main body.

11. The method of claim 10, further including the steps of:

providing a lever;

passing the lever through the aperture into the first chamber;

engaging a bottom of the canister with the lever;

leveraging the bottom of the canister with the lever to push the canister upwards; and removing the canister from the first chamber.

12. The method of claim 10, wherein the canister includes pepper spray.

13. The method of claim 10, wherein the canister includes bear spray.

14. The method of claim 10, wherein the second chamber is adapted to receive and couple to a hiking pole.

15. The method of claim 10, wherein the hiking pole is a collapsible pole.

16. The method of claim 10, wherein the handle assembly is retrofitted to an existing hiking pole.

17. The method of claim 10, wherein the handle assembly is manufactured from a rigid polymeric material.

18. The method of claim 10, wherein a portion of the canister is visible via the aperture.

19. The method of claim 10, wherein the main body is ergonomic.

20. A method of implementing a handle assembly adapted to store a canister therein, the method comprising:

providing a handle assembly and a lever, the handle assembly defined by:

a main body including a first chamber, a second chamber, and an aperture passing through opposing sidewalls of the main body and the first chamber; and a cap removably coupled to the main body;

inserting a canister into the first chamber of the main body;

attaching the cap to the main body;

removing the cap from the main body;

dispensing contents from the canister with the cap removed from the main body;

passing the lever through the aperture into the first chamber;

engaging a bottom of the canister with the lever;

leveraging the bottom of the canister with the lever to push the canister upwards; and removing the canister from the first chamber.

* * * * *